United States Patent [19]

Whitley et al.

[11] 4,365,740

[45] Dec. 28, 1982

[54] MAILBOX SIGNAL OR FLAG ASSEMBLY

[76] Inventors: John A. Whitley, 203 Randolph Ave.; Lacy A. Rowe, 1851 Skycoe Dr., both of Salem, Va. 24153

[21] Appl. No.: 180,887

[22] Filed: Aug. 25, 1980

[51] Int. Cl.[3] ..... A47G 29/12

[52] U.S. Cl. ..... 232/35

[58] Field of Search ..... 232/35

[56] References Cited

U.S. PATENT DOCUMENTS

| | | | |
|---|---|---|---|
| 1,535,677 | 4/1925 | Maserang | 232/35 |
| 1,671,520 | 5/1928 | Farrell | 232/35 |
| 1,685,874 | 10/1928 | Feist | 232/35 |
| 2,421,603 | 6/1947 | Doppelhammer | 232/35 |
| 2,693,314 | 11/1954 | Hunter | 232/35 |
| 2,809,780 | 10/1957 | Doetsch | 232/35 |
| 2,988,268 | 6/1961 | Mioduski | 232/35 |
| 3,301,475 | 1/1967 | Clark | 232/33 |
| 3,623,655 | 11/1971 | Tieszen | 232/35 |

*Primary Examiner*—William E. Lyddane
*Assistant Examiner*—Peter A. Aschenbrenner
*Attorney, Agent, or Firm*—Munson H. Lane; Munson H. Lane, Jr.

[57] ABSTRACT

The present case discloses a signal or flag assembly for use with a mailbox having a front door hinged at the lower portion thereof and comprising a body portion having sidewalls, said signal assembly comprising a flag or signal having a signal standard or support bent intermediate its ends to provide a signal carrying portion or arm and an attaching arm portion extending at an angle thereto, and pivot means for securing the attaching arm portion to one side of the mailbox. The attaching arm portion of the standard includes a pawl portion at its outer end for releasable latching connection with a signal latching member carried by said mailbox door. The signal latching member includes a spring portion extending at an angle to the mailbox door for cooperation with the pawl portion of the attaching arm portion, and weather cover means for protecting the pivot means and associated mechanism from the elements comprising a box-like structure secured to the side of the mailbox and having a cover portion spaced from the mailbox side wall and overlying the hinged portion, and open sides to permit the attaching arm to extend through one of said sides and to swing therein. The bend in the standard or support is double so as to permit the attaching arm to extend into the weather cover means, the attaching arm being offset from the signal carrying arm for this purpose by means of the double bend.

4 Claims, 5 Drawing Figures

MAILBOX SIGNAL OR FLAG ASSEMBLY

BACKGROUND AND SUMMARY OF THE INVENTION

The invention relates generally to an attachment for a conventional mailbox having the usual swinging door and, in accordance with our invention, the mailbox is equipped with a signal means or flag assembly which is pivotally supported on one side of the mailbox. Such flag assembly is adapted to be retained in raised position when the mailbox door is shut, and is so shaped and pivotally mounted as to automatically fall by gravity when released from the upright position. The operating parts of the flag assembly are mounted on the outside of the mailbox rather than internally as in some prior art devices. Accordingly an outer casing or weather covering is provided to protect the pivot and the associated mechanism of the flag from the elements. The signal assembly includes a signal support or standard bent intermediate its ends to provide a signal carrying arm and an attaching arm extending at an angle thereto, and provided with a double bend to permit the attaching arm to extend into the weather cover.

Since the flag assembly and cooperating parts are on the exterior of the mailbox, standardization and continuity of the present day style boxes are made possible at a relatively low cost. Also the novel double bend in the flag assembly support makes possible the use of the weather cover which protects the pivot and related mechanism.

SUMMARY OF THE INVENTION

In summary the present case discloses a signal or flag assembly for use with a mailbox having a front door hinged at the lower portion thereof and comprising a body portion having sidewalls, said signal assembly comprising a flag or signal having a signal standard or support bent intermediate its ends to provide a signal carrying portion or arm and an attaching arm portion extending at an angle thereto, pivot means for securing the attaching arm portion to one side of the mailbox. The attaching arm portion of the standard includes a pawl portion at its outer end for releasable latching connection with a latching member carried by said mailbox door. The latching member includes a spring portion extending at an angle to the mailbox door for cooperation with the pawl portion of the attaching arm portion, and weather cover means for protecting the pivot means and associated mechanism from the elements comprising a box-like structure secured to the side of the mailbox and having a cover portion spaced from the mailbox side wall and overlying the pivoted portion, and at least one open side to permit the attaching arm to extend therethrough and swing therein. The bend in the standard or support is double so as to permit the attaching arm to extend into the weather cover means, the attaching arm being offset from the signal carrying arm for this purpose by means of the double bend.

In accordance with the preferred embodiment of the invention, the signal standard or support comprises an elongated strap. The attaching arm extends at an angle to the signal carrying arm and a double bend is provided between the two arms so that the attached arm is offset from the signal carrying arm and is adapted to extend into one side of the weather cover box.

PRIOR ART

The following U.S. Pat. Nos. disclose free falling mailbox signal or flag assembly: 1,535,677 Maserang Apr. 28, 1925, 1,626,320 Alms Apr. 26, 1927, 2,684,197 Babcock July 20, 1954, 2,809,780 Doetsch Oct. 15, 1957, 3,623,655 Tieszen Nov. 30, 1971.

The patents listed above disclose mailbox flags which are automatically lowered when the mailbox door is opened. U.S. Pat. No. 3,623,655 shows a flag which falls by gravity once the door is opened.

See also the following U.S. Pat. Nos.: 1,671,520 Farrell May 29, 1928, 2,421,603 Doppelhammer June 3, 1947, 2,838,230 Barkdoll June 10, 1958, 2,988,268 Mioduski June 13, 1961, 3,301,475 Clark Jan. 31, 1967.

U.S. Pat. No. 2,421,603, for example, discloses a mailbox flag assembly including a flag which is weight biased relative to a pivot for the flag to a lowered position and a spring detent mounted on the edge of the mailbox door which allows the flag to be raised when the door is closed and held in raised position by the engagement of a lever arm extending from the flag beneath the detent. When the door is opened the detent disengages the flag lever arm and the flag falls to its lowered position.

As shown in U.S. Pat. No. 2,988,268, the arm 36 extending perpendicular to the flag standard 32 engages a bar 24 which extends across the front of the mailbox door. The flag is lowered by gravity when the door is opened.

As shown in U.S. Pat. No. 3,301,475, the arm 32 frictionally engages the outer side of the door flange 18 to retain the flag in raised position until the door is opened, whereupon the flag falls.

Further referring to Doppelhammer, U.S. Pat. No. 2,421,603, an important difference as compared with our flag assembly resides in the fact that the flag assembly of Doppelhammer when in raised position is positively captured and held, and cannot be lowered manually without damage to the part 21 (detent) in FIG. 1 or the part or detent 23 of FIG. 5 when the door is in closed position. In our device, the flag assembly can be lowered independently of the door position, up or down.

In U.S. Pat. No. 2,988,268, Mioduski, a very close manual portion of the flag is required to bring about cooperation between the part 40 and part 24, which is lacking in simplicity and is time consuming in operation.

The drawings of the present case show the mailbox and flag assembly in raised and lowered positions. When the flag assembly is in its raised position, it is held by abutment of the pawl end of the attaching arm with the catch or spring attached to the mailbox door. When the door is opened, the flag falls by its own weight to the lowered position shown in the drawing with the door opened.

An important feature of the present invention resides in the fact that the flag assembly can be lowered manually without opening the door by pushing the flag clockwise. In so doing the pawl of the flag assembly will push against the spring on the door and the spring will give sufficiently to permit the pawl arm to pass without opening the door.

The invention will be more fully understood by reference to the accompanying drawings and the following detailed description showing an illustrative embodiment of a preferred form of the invention.

DETAILED DESCRIPTION OF PREFERRED EMBODIMENT

Figure 1:
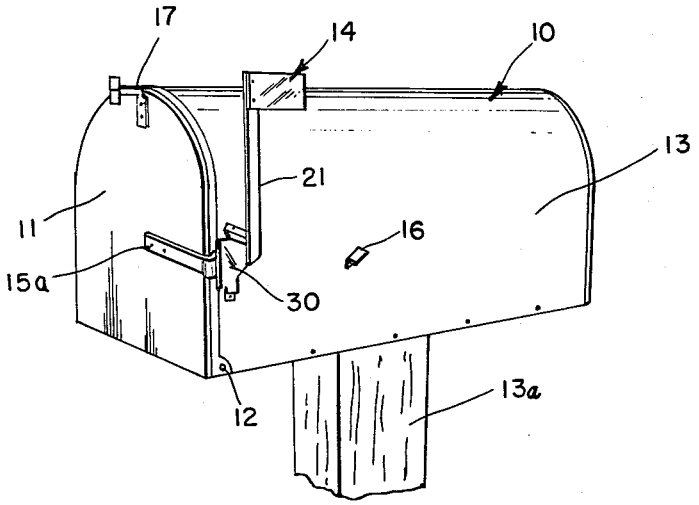
FIG. 1 is a perspective view of a mailbox provided with our improved mailbox signal or flag assembly with the mailbox door shown in closed position and the signal assembly in raised position.

Referring first to FIG. 1 wherein the principal elements of the device are shown, the reference numeral 10 denotes generally a conventional mailbox having a front door portion 11 provided with a hinge 12 at the lower portion thereof and a main body portion 13 of conventional form which may be supported on a post 13*a*.

Figure 2:
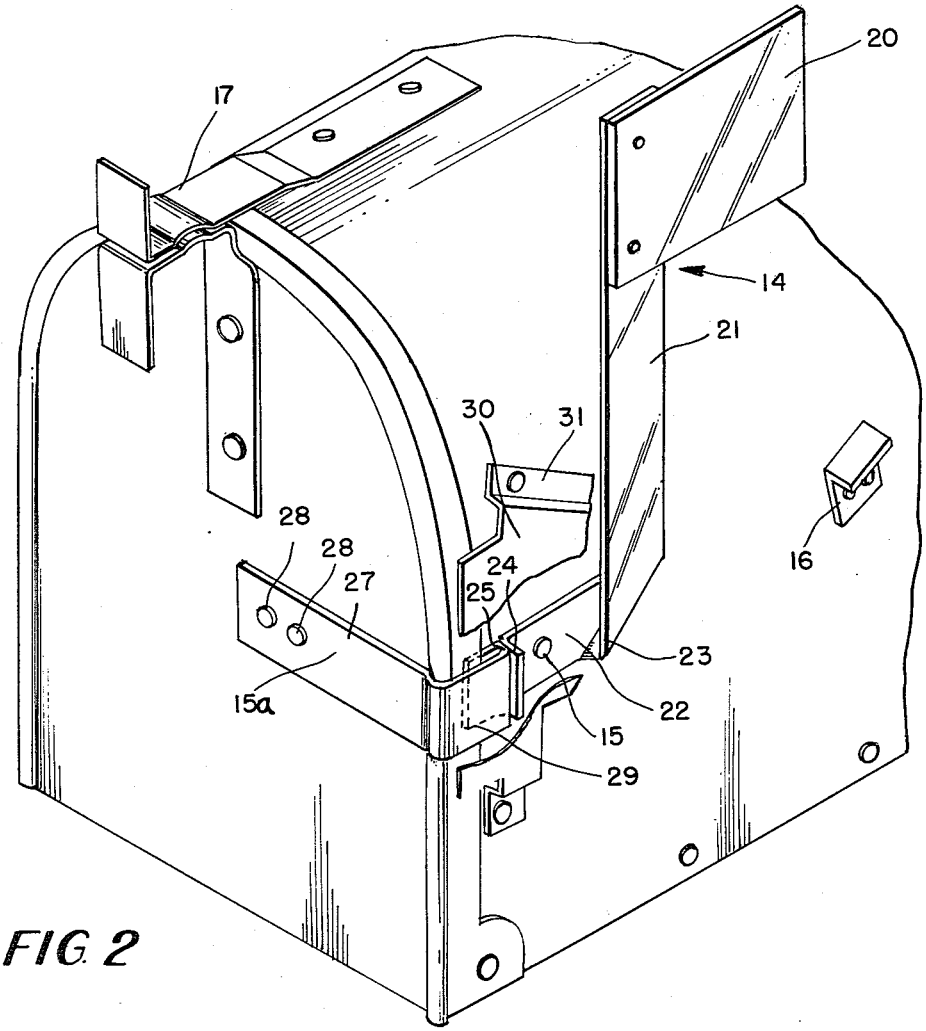
FIG. 2 is a view similar to FIG. 1 but on an enlarged scale and showing further detail of the front end only of the mailbox with the mailbox signal of the flag assembly shown in raised position.
Figure 3:
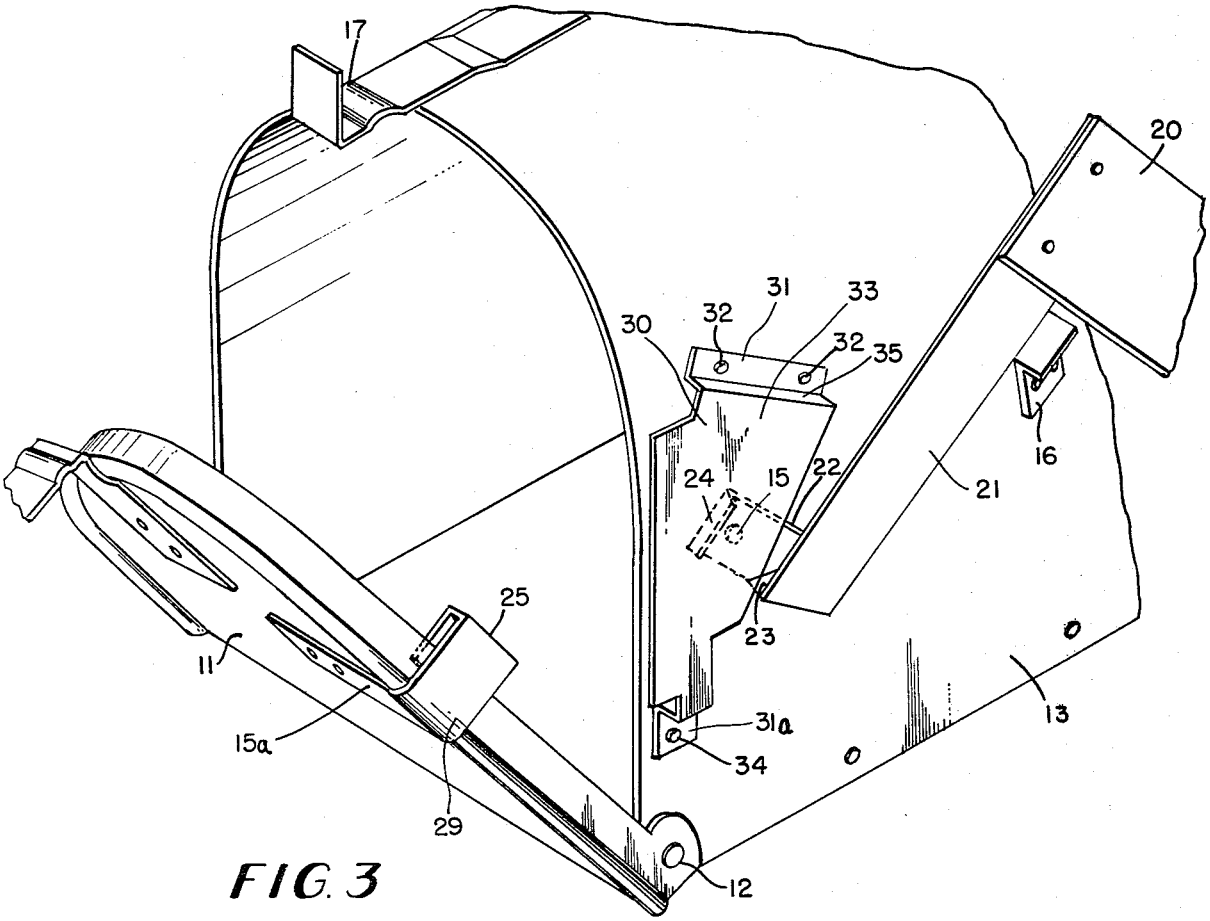
FIG. 3 is a view similar to FIG. 2 but with the mailbox door open and the flag assembly in lowered position.

A signal assembly 14 is shown in upright position in FIGS. 1 and 2, and in lowered position in FIG. 3. The signal assembly is pivotally mounted at 15 (FIGS. 2 & 3) and, unless supported in an upright position by a suitable signal latching means member or spring 15*a*, will tend to fall by gravity to the lower position shown in FIG. 3, by reason of its offset mounting. Suitable lower stop means 16 is attached to the side of the mailbox body, and conventional mailbox door latching means generally designated 17, coact between the body of the mailbox and the front door. The door latching means 17 normally holds the door in closed position but may be opened by the mailman or by the box owner. See for example U.S. Pat. Nos. 2,809,780 and 3,623,655, supra, for suitable door latching means.

Our improvement resides in the construction and mounting of the signal assembly 14 and more particularly in the supporting means therefor and its cooperation with the spring latching means 15*a* and weather cover 30 as will be more fully described.

Referring particularly to FIG. 2, the signal assembly 14 includes a flag or other signal 20 and an elongated strap, stem or supporting member 21 which, in the upright position of the signal, shown in FIGS. 1 and 2 may be substantially vertical and a laterally offset portion 22 through which the pivot 15 extends. The upright portion or arm 21 and lateral portion or arm 22 are connected by a double bend portion 23 so that the two supporting members 21 and 22 are offset and spaced apart. At the outer extremity of the member 22 is a hook-like pawl portion 24 which is adapted to abut a coacting hook member 25 at the extremity of the spring latching member 15*a*.

Signal Latch Member 15*a*

As shown, the signal latch member generally designated 15*a* cooperates with the pawl member 24 of the arm 22 of the signal assembly 14 and comprises a leaf spring including an elongated portion 27 extending part way across the front door of the mailbox and secured adjacent one end thereof to the door by means of rivets 28 or by spot welding. Extended from the outer end of portion 27 of the latching means 15*a* is a bent-over spring portion 29, the extremity of which comprises the hook member 25 previously referred to which coacts with the pawl portion 24 of the arm 22 of the signal assembly 14 when the signal assembly is in the upright position shown in FIGS. 1 and 2 of the drawings.

Weather Cover Means

As shown, a weather cover means generally designated 30 is provided to protect the pivot 15 and associated mechanism of the signal support assembly.

The weather cover means 30 comprises a box-like member having a flange portion 31 offset from the top of the cover and secured to the side of the mailbox by any suitable means, as by rivets 32 or by spot welding. The top cover portion 33 of the box is spaced from the side of the mailbox and may be secured at its lower end by a flange 31*a* by a rivet 34 or by spot welding.

Figure 4:
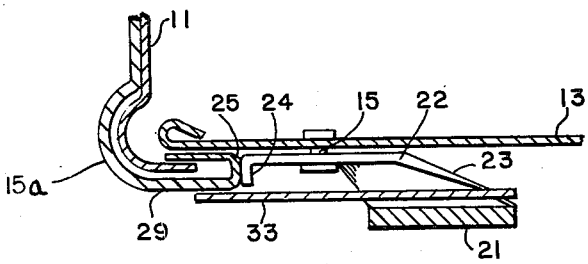
FIGS. 4 and 5 are detail sectional views showing specifically the cooperation of the flag assembly and the spring latching means therefor shown in FIGS. 1–3.
Figure 5:
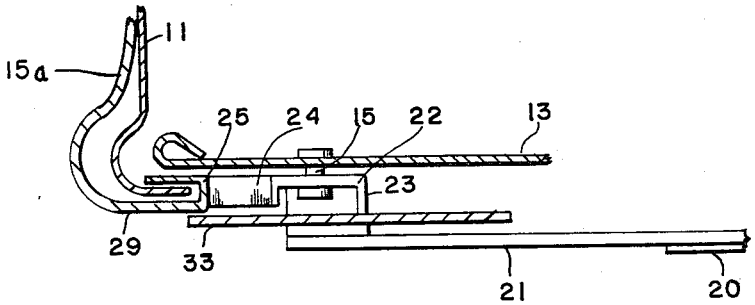

The opposite sides of the box are open as shown in FIGS. 3, 4 and 5, to allow passage of the attaching arm 22 for the signal assembly on one side and the bent over spring portion 29 of the signal latching member 15*a* on the other side. The end wall 35 serves as an upper stop to limit upward movement of the signal mechanism. The intermediate double bend portion 23 of the signal support forms a bight about the one open side of the cover portion so that in the raised position of the signal flag 20, as seen particularly in FIG. 4, the signal carrying arm 21 and the attaching arm 22 are located one on the outside of the cover and the other on the inside of the cover 33.

Operation

As the flag assembly is manually raised with the door in closed position, the pawl part 24 of the flag assembly arm 22 makes contact with the cooperating face 25 on the U-shaped spring portion 29 of the latching mechanism, pushing the spring 29 out of the way of the radial path of the pawl 24, causing the U-bend spring 29 to further encapture the leading edge of the door. As the pawl 24 is in final upright position, the spring 29 holds the flag assembly upright at this contact point. The weather cover 30 also serves as the upper limit portion for the flag assembly. Manual manipulation of the signal carrying arm 21 to lower same from the raised position can be effected without opening the mailbox door 11. A clockwise force applied to the signal carrying arm 21 rotates the attaching arm 22 about pivot 15. The pawl portion 24 contacting the latching portion 25 of the signal latching spring 15*a* causes the latching spring 15*a* to yield, permitting the signal carrying arm 21 to be lowered against the stop 16. Opening the door 11 when the signal carry arm 21 is in the raised position, will remove the latching portion 25 from contact with the pawl portion 24, whereupon the signal flag will fall under its own weight to its lowered position as shown in FIG. 3.

For reference purpose, copies of photographs are enclosed. Photo 1 shows the door in closed position and the flag assembly upright, and photo 2 shows the door open and the flag lowered.

If desired, our improved flag assembly may be used in connection with a mailbox door operating means such as is shown in our U.S. Pat. No. 3,733,026 and in our application Ser. No. 26,307, filed Apr. 1, 1979, now U.S. Pat. No. 4,223,828 dated Sept. 23, 1980.

What is claimed is:

1. For use with a mailbox having a front door hinged at the lower portion thereof and comprising a body portion having sidewalls; a signal assembly comprising a signal flag having a signal standard, or support of elongated strap material bent intermediate its ends to provide a signal carrying arm, an intermediate double bend portion and an attaching arm offset from and extending at an angle to said signal carrying arm, pivot means for pivotally mounting said attaching arm portion to one side of the mailbox, said attaching arm of said signal standard including a pawl portion at one end for abutting contact with a signal latching member carried by said mailbox door, said signal latching member including a leaf spring portion extending across the front of said door and a latching portion extending at an angle to the mailbox door toward said pawl portion for cooperation with the pawl portion of the attaching arm to hold said signal carrying arm in upright position; and weather cover means for protecting the pivot means and associated mechanism from the elements comprising a box-like structure secured to the side of the mailbox and having a cover spaced from the mailbox side wall and overlying said pivot means and said attaching arm portion and open sides, said attaching arm extending through one of said open sides and swingable therein, said other side of said cover being open to permit said latching portion of said latching member to extend therethrough into abutting contact with said pawl portion of said attaching arm, said intermediate double bend portion forming a bight about said cover on said one open side to permit the attaching arm to extend into the weather cover means while the signal standard remains outside of said cover, said bight being engageable with said cover on said one open side to limit upward movement of said signal carrying arm, said pawl portion contacting said latching portion of said signal latching member when said mailbox door is closed and said signal carrying arm is raised, said latching member being yieldable upon manual manipulation of said signal carrying arm to permit said signal arm to be lowered from its raised and latched position while said door remains closed.

2. The signal assembly of claim 1 wherein said attaching arm and said signal carrying arm are in spaced parallel planes.

3. The signal assembly of claim 1 wherein said latching portion of said signal latching member has a flat surface facing said pawl portion and said pawl portion has a flat surface facing said flat surface of said latching portion for abutting contact therewith.

4. The signal assembly of claim 1 wherein a lower limit stop is provided on the side of said mailbox to support said signal carrying arm in its lowered position.

* * * * *